United States Patent [19]

Rienzo

[11] 4,117,965

[45] Oct. 3, 1978

[54] SELF-BALANCING TRAY

[75] Inventor: Donald D. Rienzo, Dix Hills, N.Y.

[73] Assignee: Allan Tackle Manufacturing Co., Inc., Hicksville, N.Y.

[21] Appl. No.: 821,638

[22] Filed: Aug. 4, 1977

[51] Int. Cl.[2] ..... A47G 23/06

[52] U.S. Cl. ..... 224/48 R; 220/95

[58] Field of Search ..... 224/48 R, 48 W; 206/199, 202, 62; 294/87 A; 220/95

[56] References Cited

U.S. PATENT DOCUMENTS

| | | | |
|---|---|---|---|
| 3,199,720 | 8/1965 | Folman et al. | 224/48 R |
| 3,851,808 | 12/1974 | Schilling | 224/48 R |

FOREIGN PATENT DOCUMENTS

| | | | |
|---|---|---|---|
| 119,877 | 10/1943 | Australia | 224/48 R |
| 636,191 | 1/1920 | France | 224/48 W |
| 801,050 | 1/1955 | United Kingdom | 224/48 R |

*Primary Examiner*—Trygve M. Blix
*Assistant Examiner*—Kenneth W. Noland
*Attorney, Agent, or Firm*—Hane, Roberts, Spiecens & Cohen

[57] ABSTRACT

A self-balancing tray for carrying glasses, cups, canapes consists of a disc supported by a frame to which a holder is releasably attached. A grip is fastened to the holder by a freely board-able thread or chain at a point coaxial with the center of the disc thereby causing the tray to assume a horizontal position irrespective of motions applied to the grip when the tray is carried.

9 Claims, 5 Drawing Figures

SELF-BALANCING TRAY

The present invention relates to trays for carrying glasses and/or cups, canapes, crackers, etc; and more particularly to a self-balancing tray for carrying glasses etc.

BACKGROUND

At parties or meetings in a home or outside, the host and the hostess or help if available usually supply the guests with beverages, canapes etc. If a number of persons is to be served and particularly when there is a considerable distance between the source of supplies and the guests which is often the case, it is desirable to load a tray with glasses, cups, plates with canapes etc. It is a general experience that spilling from such loaded trays occurs not infrequently.

Attempts have been made to provide more or less spillsafe trays for the above referred to purposes such as trays with a high border. Attempts have also been made to provide trays tending to assume automatically a position inhibiting spillage. U.S. Pat. Nos. 1,676,988 2,384,794 2,425,952 and 3,447,728 are directed to tray structures preventing or at least reducing spillage from the tray when carried. However, none of the tray structures disclosed in the listed patents is satisfactory for the purpose. Moreover, the constructions of the prior art trays make storage space consuming and impractical.

THE INVENTION

It is a broad object of the invention to provide a novel and improved tray of the general type above referred to which automatically assumes and retains a horizontal position when carried, that is, a tray which is self-balancing.

A more specific object of the invention is to provide a novel and improved self-balancing tray which automatically assures and retains a horizontal position when carried by a person with one hand and such person walks swinging his or her arms in natural fashion when walking, thus avoiding sliding of items from the tray.

A still further object of the invention is to provide a novel and improved self-balancing tray which can be assembled and disassembled rapidly without the use of tools or tightening and loosening of screws, and which when disassembled occupies little space and can thus be conveniently stored.

SUMMARY OF THE INVENTION

The afore pointed-out objects, features and advantages and other objects, features and advantages which will be pointed out hereonafter and set forth in the appended claims are obtained by providing a disc preferably a circular disc and a frame for supporting the disc. This frame fits the disc and automatically supports the same by studs inwardly protruding from the frame and underlying the disc when inserted into the frame.

To carry the frame with the disc inserted thereinto a holder is provided which can be attached to the frame by snapping lugs protruding from the holder into receiving openings in the frame. Conversely, receiving openings may be provided in the holder and the lugs on the frame. The holder is shaped and dimensioned so that it spans the width of the frame and that glasses, cups etc. can be placed upon and removed from the disc without difficulty.

The holder has preferably a semi-circular configuration and is made of elastic material so that the lugs can be inserted into the receiving openings on the frame and held therein by slightly spreading the holder and release it after insertion of the lugs. Detachment of the holder is effected by again spreading the holder sufficiently to withdraw the lugs from the openings. The tray is carried by means of a grip which is secured to a holder by a freely bendable soft wire, or a chain which is secured to the holder at a point coaxial with the center point of the frame and the disc.

BRIEF DESCRIPTION OF THE INVENTION

In the accompanying drawing an embodiment of the invention is shown by way of illustration and not by way of limitation.

IN THE DRAWING

DETAILED DESCRIPTION OF THE INVENTION

Figure 1:
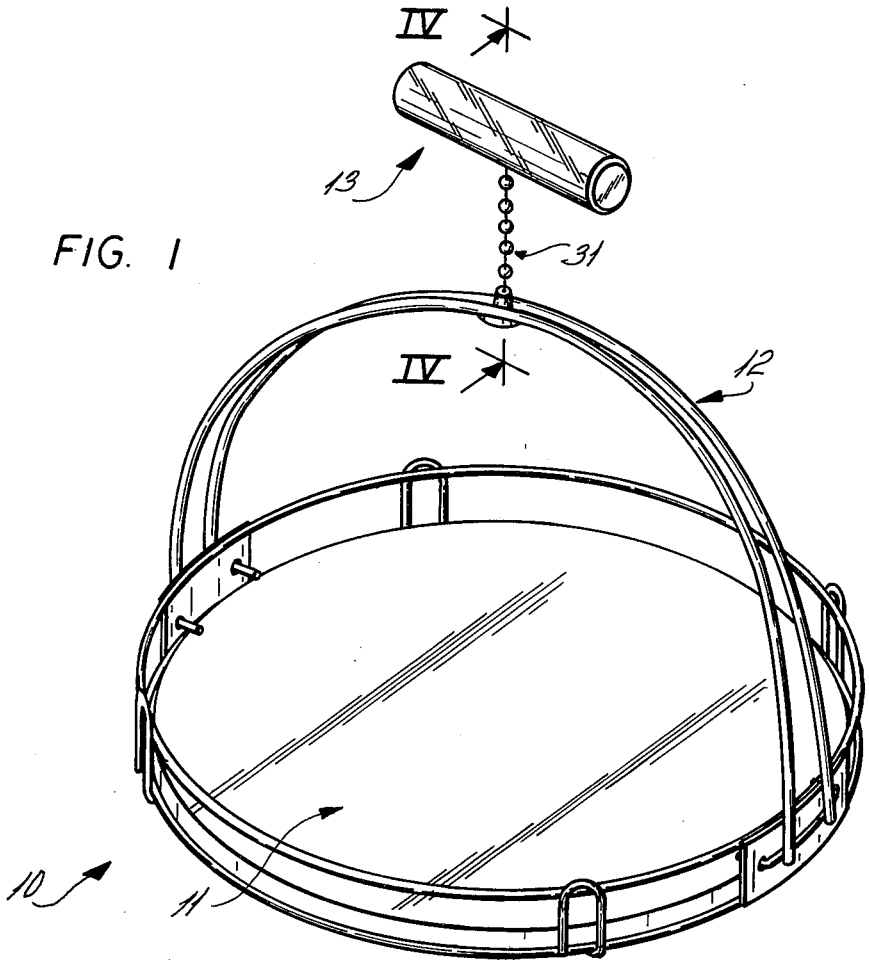
FIG. 1 is a perspective view of an assembled self-balancing tray according to the invention.
Figure 2:
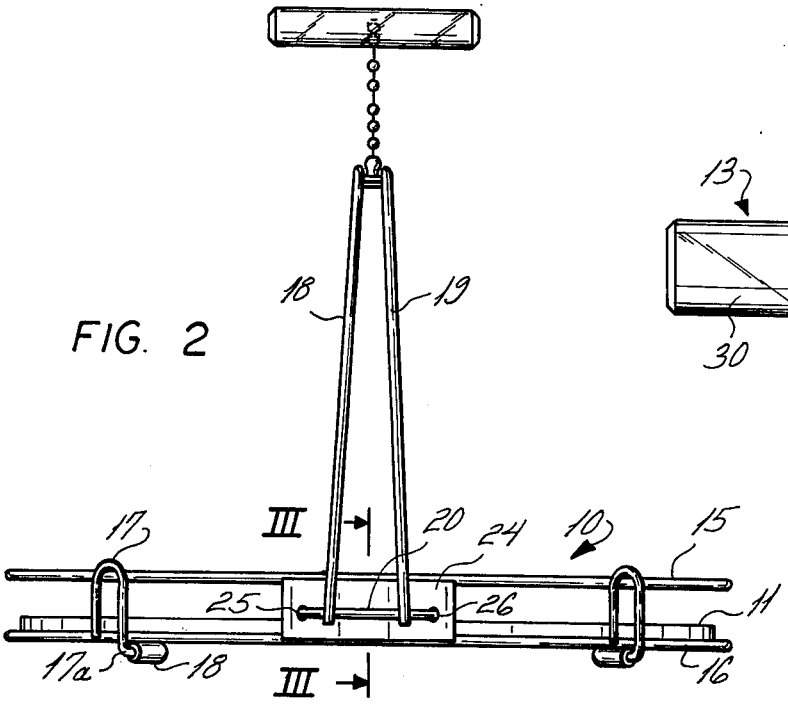
FIG. 2 is an elevational side view of the tray according to FIG. 1.

Referring to the drawing figures more in detail, the self-balancing tray according to the invention as shown consists of a frame 10, a disc 11 supported by the frame, a holder 12 attached to the frame for supporting the same, and a handle 13 attached to the holder.

The holder 12 has a substantially semi-circular configuration. It is formed of two wires 18 and 19 secured to each other, spaced apart, by crosswise disposed strips such as wires 20 secured to wires 18 and 19, for instance by soldering. The wires 18 and 19 shown to be closer to each other at the mid portion thereof, but they may also be parallel to each other. Instead of two wires, a single strip of metal or other sufficiently rigid and strong material — for instance a hard synthetic plastics material — may also be used. While a semi-circular configuration of the holder is preferable, the holder may also be otherwise shaped, for instance it may be part of an oval or the holder may have a hyperbolic shape.

The diameter of the holder at the ends thereof is substantially equal to the diameter of the frame, preferably slightly smaller than the diameter of the frame. The strips forming the holder should advantageously be flexible.

Figure 3:
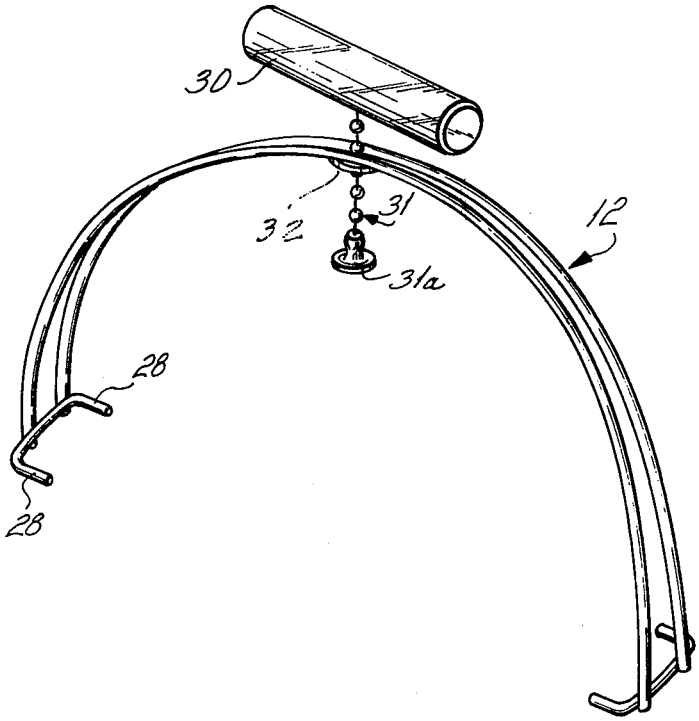
FIG. 3 is a section taken on line III—III of FIG. 2 on an enlarged scale.

Attachment of the holder to the frame is effected by providing on the frame at diametrically opposite portions thereof, a strip 24 fixedly secured to wires 15 and 16. This strip has two circumferentially spaced apart holes 25 and 26 which constitute receiving holes for lugs or pins 28 radially inwardly extending from cross wires 20 at the ends of the holder. Pins 28 have a dual purpose, namely, to fasten the holder releasbly to the frame and further to lock the disc in position by overlying the same, as is best shown in FIG. 3.

Figure 4:
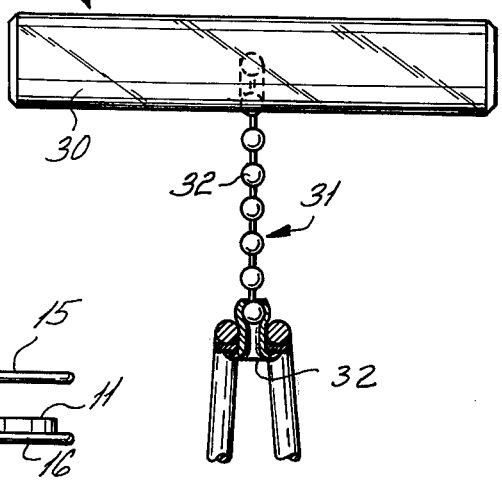
FIG. 4 is a fragmentary view of the tray showing the holder part of the tray on an enlarged scale.
Figure 5:
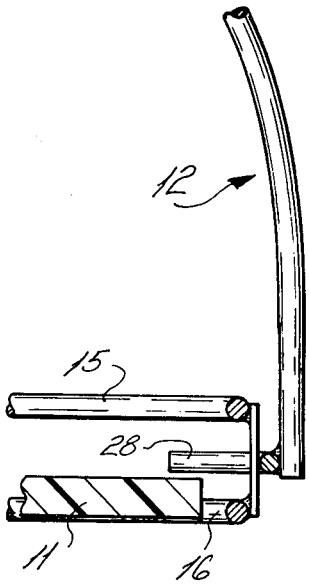
FIG. 5 is an exploded view of the parts of the tray as shown in FIG. 1.
Figure 5:
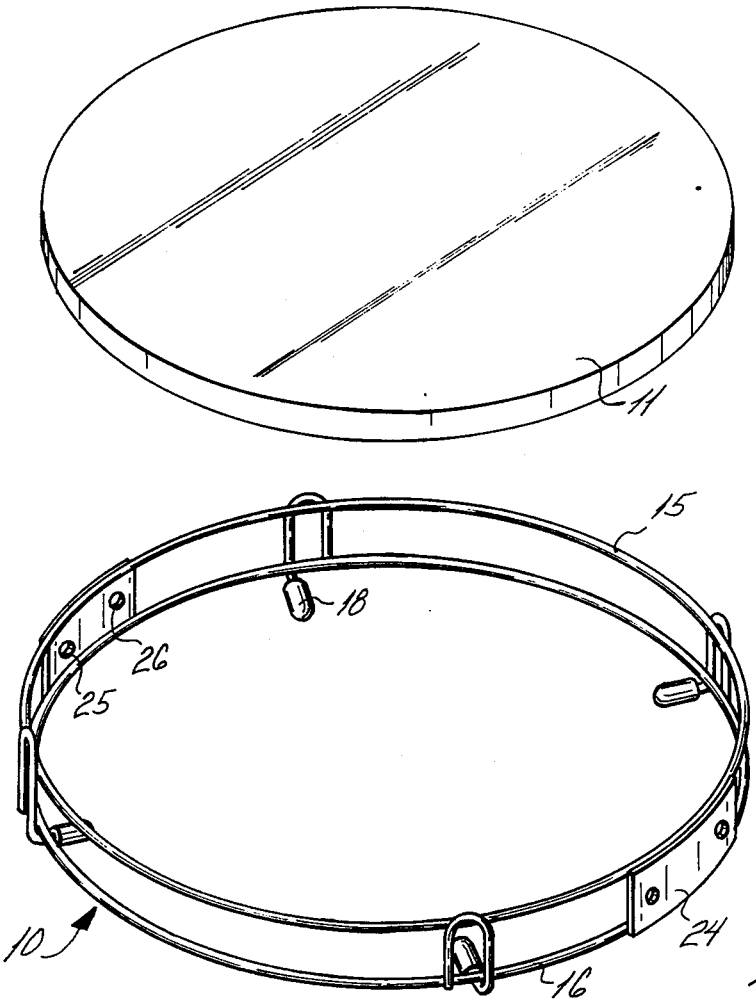

Referring to FIG. 4, the tray is carried by a handle comprising a grip 30 such as a cylindrical bar made, for instance, of suitable synthetic plastics material, and secured preferably at its mid portion to one end of an elongate flexible member 31. The other end of member 31 is secured to the holder 12, preferably by means of a bracket 32 fixedly secured to holder wires 18 and 19. As it is shown in FIG. 5, there is provided an opening in bracket 32 through which member 31 is extended and retained by a plate 31*a* in position. Member 31 is shown as a soft wire upon which small spaced-apart balls may be threaded. The member may also be a link chain or a strip of soft material such as rubber. It is essential that the point at which flexible member 31 is secured to the holder is coaxial with the center point of the disc and thus of the frame.

ASSEMBLY AND DISASSEMBLY OF THE SELF-BALANCING TRAY

Referring to FIG. 5 which shows the components of the tray fully diaassembled, — assembly is effected by inserting disc 11 into frame 10. The disc is retained in the frame by resting on legs 17*a* and/or sleeves 18. The next step is attaching the holder 12 to the frame. This attachment is effected by spreading the end portions of the holder sufficiently to permit insertion of pins 28 on the holder into receiving openings 25 and 26. After such insertion, the holder when released will snap back into its relaxed position, thus locking the holder to the frame and also further locking the disc in the frame.

Disassembly of the tray is effected by reversing the aforedescribed steps.

As it is evident, if the assembled tray is carried by grip bar 30 it will automatically tend to assume a position in which the disc is horizontal and will also tend to retain this position even when the tray is carried by a person imposing movements to the grip of the tray, for instance by swinging his arms while walking carrying the tray. As a result, glasses, cups and other items placed on the tray will not slide off, thereby reducing the risk of spilling even if the tray is fully loaded.

Instead of two lugs and two openings at each end of the holder and in the frame, respectively, one lug at each end of the holder and one coacting opening in the frame may be provided. Such arrangement permits folding of the holder upon the frame, thereby reducing the required storage space without disassembly of the tray.

While the invention has been described in detail with respect to a certain now preferred example and embodiment of the invention, it will be understood by those skilled in the art, after understanding the invention, that various changes and modifications may be made without departing from the spirit and scope of the invention, and it is intended, therefore, to cover all such changes and modifications in the appended claims.

What is claimed is:

1. A self-balancing tray for carrying open receptacles containing spillable contents, fragile items or items splattering when falling down, said tray comprising:

a disc of substantially rigid material; and an assemblage for mounting the disc and carrying the same in always substantially horizontal position, said assemblage comprising a frame shaped to encompass the rim of the disc with a loose fit, lugs inwardly protruding from the frame fixedly secured thereto and underlying the disc upon placement thereof into the frame, thereby supporting the disc; and a holder shaped to extend across the frame spaced apart therefrom to provide space for placing receptacles and other items upon the disc, mounting means for releasably attaching the holder to the frame and locking the disc within the frame, said mounting means including two pairs of receiving openings and disposed at opposite points of the frame and at each end of the holder a pair of spaced apart lugs insertable into the respective openings on the frame, said lugs on the holder being insertable into said openings at the frame and being dimensioned to overlie the disc thereby locking the disc in the frame; and a handle including a grip and a freely bendable connecting member secured at one end to the grip and at the other end to the holder at a point thereof coaxial with the center point of the disc.

2. The tray according to claim 1 wherein said frame comprises two strips disposed parallel to each other, and wherein a pair of spacers are fixedly secured to said strips for holding the same in said parallel positions, each of said spacers including a pair of said receiving openings.

3. The tray according to claim 1 wherein said holder consists of a strap, and a bar is crosswise secured at each end of said strap, each of said crosswise bars having secured thereto a pair of said lugs for locking the disc to the frame.

4. The tray according to claim 1 wherein said disc is a circular disc and said frame is a circular frame.

5. The tray according to claim 4 wherein said holder is a semi-circular strap, said strap having a diameter substantially equal to that of the frame but being flexibly bendable for inserting the lugs on the holder into the receiving openings in the frame.

6. The tray according to claim 5 wherein said strap comprises two wires and fastening means fastening said wires in spaced apart fixed positions.

7. The tray according to claim 4 wherein lugs extending radially inwardly from said holder and being insertable into said receiving openings in the frame upon bending outwardly the holder ends thereby locking the lugs in the opening upon release of the holder for returning into its relaxed position.

8. The tray according to claim 4 wherein said semicircularly shaped holder is disposed at a right angle relative to the frame and the disc.

9. The tray according to claim 1 wherein said connecting member comprises a soft wire, and said grip is a bar, said wire being secured at one end to said bar and at the other end to the mid point of said holder.

* * * * *